United States Patent [19]

Polomchak et al.

[11] Patent Number: 4,729,734

[45] Date of Patent: Mar. 8, 1988

[54] DEVICE FOR IMPROVED COMBUSTION

[76] Inventors: Robert W. Polomchak; Michael Yacko, both of Rural Rte. 1, Fair Oaks, Ind. 47943

[21] Appl. No.: 887,245

[22] Filed: Jul. 18, 1986

[51] Int. Cl.[4] ..... F23M 9/00

[52] U.S. Cl. ..... 431/183; 431/8; 431/185; 239/404

[58] Field of Search ..... 431/8, 182, 183, 184, 431/185, 354; 239/399, 402, 403, 404; 48/180 C, 180, 180 F

[56] References Cited

U.S. PATENT DOCUMENTS 3,864,073 2/1975 Kolhi ..... 431/115

3,980,233 9/1976 Simmons et al. ..... 239/404 X

*Primary Examiner*—Margaret A. Focarino

*Attorney, Agent, or Firm*—Welsh & Katz, Ltd.

[57] ABSTRACT

A device for improved combustion of gaseous fuel and air includes a tubular housing and has a combustion chamber disposed about the tubular housing. A first conduit extends from one end of the tubular housing for the passage of air therethrough. A second conduit extends coaxially through the first conduit and tubular housing and has a circular baffle cooperative therewith so as to retard the passage of air. A circular opening in the second end of the tubular housing has an annular baffle disposed therein to assist in retarding flow of air. A series of curvilinear fins are disposed in a spiral configuration between the circular baffle and the annular baffle so as to effect a swirling motion of air passing therethrough. An end cap is attached to the end of the second conduit with a circular baffle at one end of the end cap, an annular baffle at the other end and fins disposed therebetween. Gaseous fuel passes through the second conduit and the end cap. The end cap imparts a swirling turbulence to the gaseous fuel passing therethrough. As a result, a stream of turbulent gaseous fuel is emitted from the end cap and a stream of turbulent air is emitted from the tubular housing. The turbulent air circumferentially surrounds the turbulent gaseous fuel and intermixes therewith so as to form a mushroom shaped flame within the combustion chamber. Substantially complete oxidation of the gaseous fuel is thereby accomplished and noxious waste gases are substantially eliminated.

17 Claims, 6 Drawing Figures

56
58
50
52
44
48
54
46
78
42
38
40
36
30
28
72
12
24

110
60
104
106
108
42
58
60
38
22
78
100
80
36
12
76
74
24
30
102
26

DEVICE FOR IMPROVED COMBUSTION

BACKGROUND OF THE INVENTION

The present invention to combustion devices and more particularly to gas burners of the type which mix gas with air before the gas reaches the combustion chamber of a furnace or boiler.

A wide variety of burner devices have been produced in the past with the object of improving the efficiency of combustion of the gas air mixture. One of the means known for improving such efficiency is to use a variety of fins or blades for swirling the gas and air when mixing them together, so as to more thoroughly intermix the gas and air prior to combustion. Despite the wide number of such devices, however, relatively low levels of efficiency have been achieved, with the result that none of the devices have achieved widespread commercial success. In point of fact, as a result of the need for such devices, pulse fuel devices have been developed which are presently becoming more and more widely used. However, such pulse fuel devices are relatively expensive.

One of the principal difficulties found in prior art devices for mixing gas and air has been the failure to find the precise positioning and construction of fins in the combustion chamber used to cause the swirling motion of gas and air respectively so as to optimize efficiency of the system. In addition, the positioning of the outlets for the gas and the air, which affects the degree of intermixing, have never been fully perfected.

Accordingly, it is an object of the present invention to provide an inexpensive gas air mixer which will function to intimately mix the gas and air so as to obtain proper burning thereof.

The present invention is a device for improved combustion of gaseous fuel and air. The device includes a tubular housing having first and second ends, each have a circular opening therethrough. A combustion chamber is disposed about the second end of the tubular housing for reception of the gaseous fuel and air mixture. A first conduit extends from the first end of the tubular housing and is in fluid communication with the tubular housing so as to direct the flow of air therethrough. A second conduit is axially disposed within the first conduit and extends through the first conduit and through the tubular housing so as to direct the flow of gaseous fuel therethrough.

A circular baffle is radially disposed about the second conduit within the tubular housing. The circular baffle retards the flow of air through the tubular housing. An annular baffle is disposed in the circular opening in the second end of the tubular housing, which also retards the flow of air through the tubular housing. A plurality of curvilinear fins are disposed in a spiral configuration between the circular baffle and the annular baffle. The fins are disposed so as to effect a swirling motion to the air passing through the tubular housing.

In a preferred embodiment, the annular baffle is sloped outwardly from the periphery of the tubular housing toward the end cap and the end cap extends slightly from the tubular housing. The annular baffle angularly directs the air passing from the tubular housing toward the gaseous fuel passing from the second conduit.

An end cap is attached to the second end of the second conduit. The end cap has a circular baffle at its proximal end, an annular baffle at its distal end and a plurality of end caps fins extending therebetween. The end cap is designed to impart a swirling turbulence to the gaseous fuel passing therethrough. As a result, a stream of turbulent gaseous fuel is emitted from the end cap member and a stream of air is emitted from the circular opening in the annular baffle. The turbulent air is circumferentially disposed about the turbulent gaseous fuel and intermixes therewith so as to form a mushroom shaped flame within the combustion chamber when the mixture is ignited. The mushroom shaped flame is surrounded by turbulent air and is not in contact with the interior surface of the combustion chamber. This mushroom shaped configuration results in virtually complete oxidation of the gaseous fuel. As a result, waste gases are substantially eliminated as a by-product of the combustion.

DETAILED DESCRIPTION OF THE PREFERRED EMBODIMENT

Figure 1:
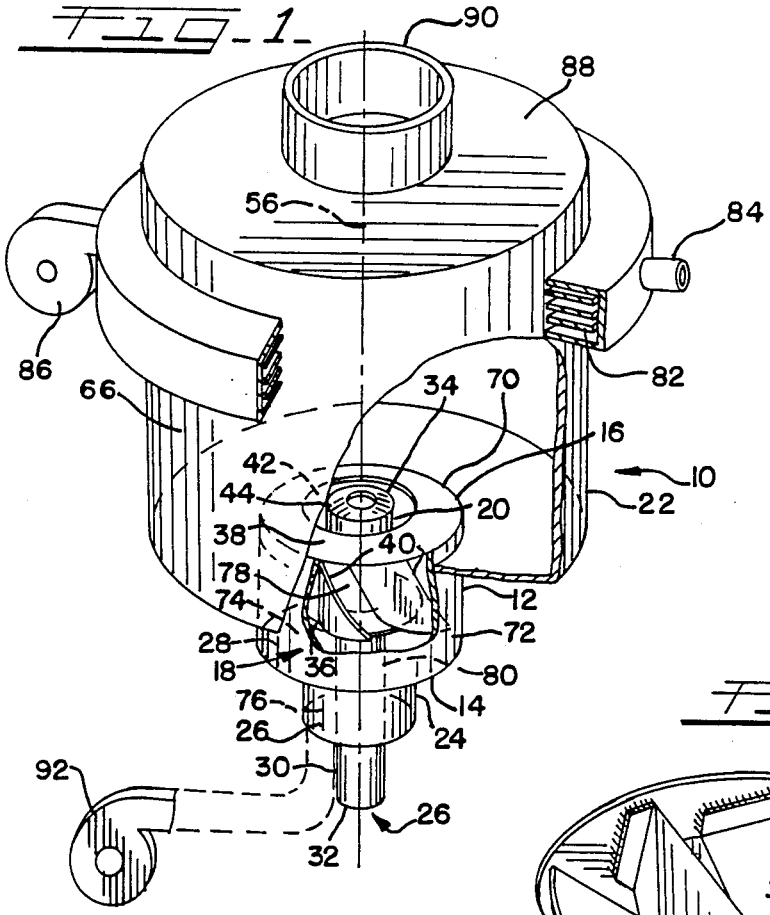
FIG. 1 is a front perspective view, partially broken away, of the improved combustion device of the present invention.

While the present invention is susceptible of embodiment in many different forms, there is shown in the drawings, and will hereinafter be described in detail, several specific embodiments, with the understanding that the invention is not limited thereto, except insofar as those who have the disclosure before them are able to make modifications and variations therein without departing from the scope of the invention.

Turning now to FIG. 1, a device 10 for improved combustion of gaseous fuel and air is shown. Device 10 includes a tubular housing member 12 having a first end 14 and a second end 16. The first end 14 has a circular opening 18 therethrough, and the second end 16 has a circular opening 20 therethrough. A combustion chamber 22 is disposed about the second end 16 of the tubular housing member 12. A first conduit 24 extends axially from the first end 14 of the tubular housing member 12. The first conduit 24 is in fluid communication with the tubular housing member 12. By this it is meant that the first conduit 24 has a lumen 26 extending therethrough into a central chamber 28 of the tubular housing member 12. A second conduit 30 having a first end 32 and a second end 34 is axially disposed within the first conduit 24. The second conduit 30 extends axially through the first conduit 24 and through the tubular housing 12 so as to allow the passage of gaseous fuel 62 therethrough. In a preferred embodiment, natural gas in the form of a vapor is the gaseous fuel described. However, other fuels in both vaporized and liquid state may be utilized.

Figure 3:
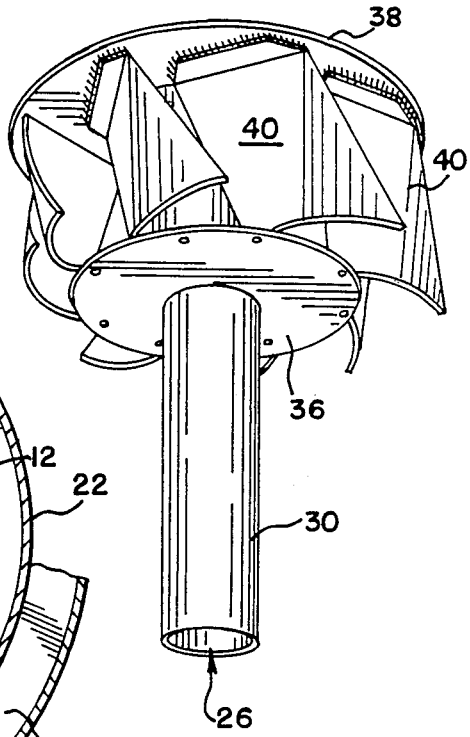
FIG. 3 is a front perspective view of a second conduit, a circular baffle, a plurality of curvilinear fins and an annular baffle used in the improved combustion device of FIG. 1.
Figure 2:
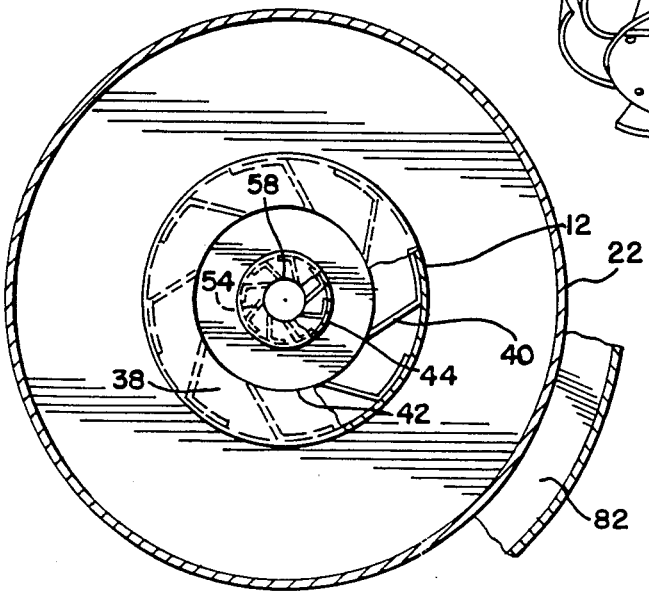
FIG. 2 is a top cut away view of the improved combustion nozzle of the present invention.
Figure 4:
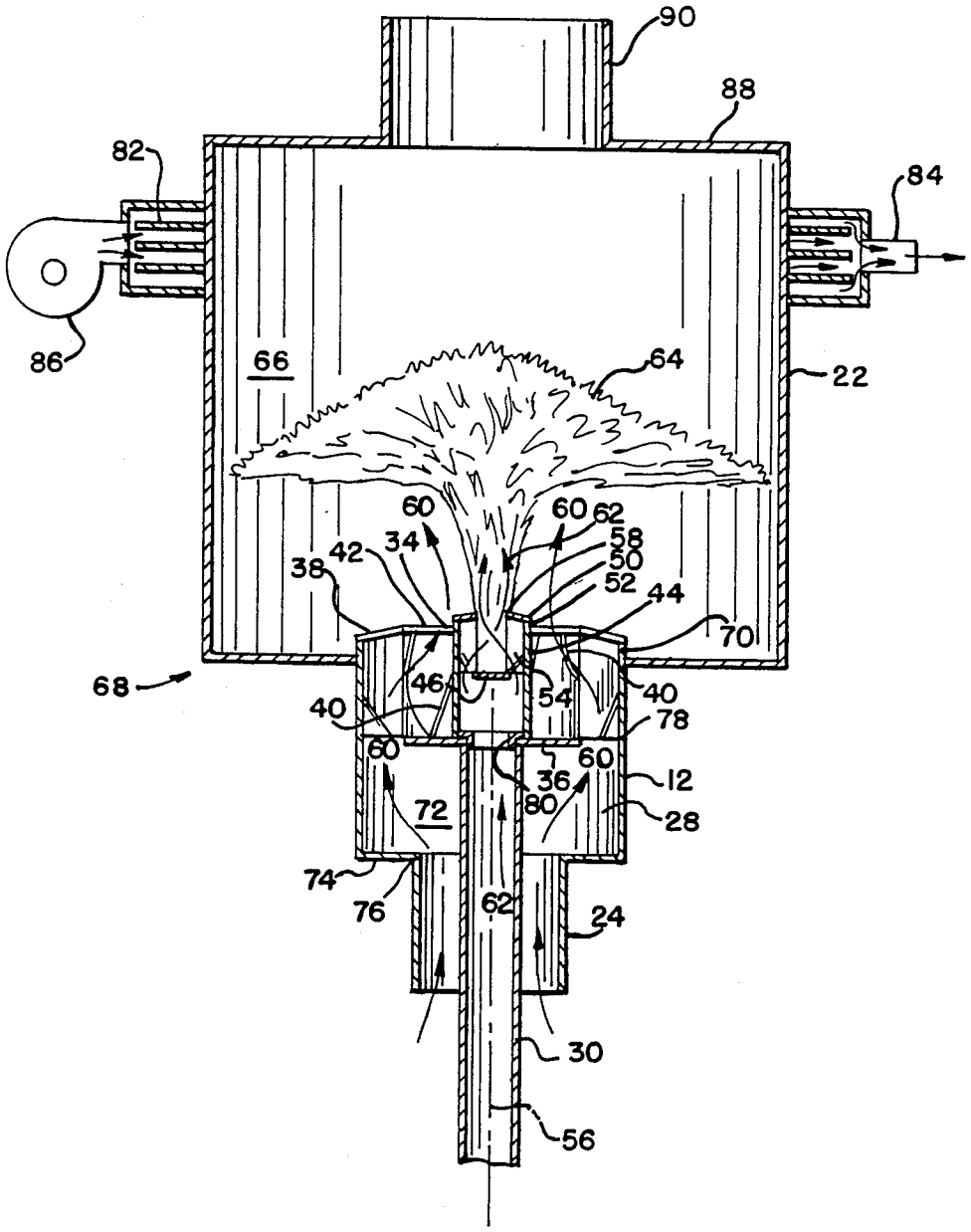
FIG. 4 is a vertical section of the improved combustion device of FIG. 1.

As shown in FIGS. 3 and 4 of the drawings, a circular baffle 36 is circumferentially disposed about the second conduit 30 within the central chamber 28 of the tubular housing 12. The circular baffle 36 is sized and positioned so as to retard the flow of air 60 passing from the first conduit 24 through the tubular housing 12. An annular baffle 38 is disposed in the circular opening 20 in the second end 16 of the tubular housing 12. The annular baffle 38 also retards the flow of air out of the tubular housing 12. A series of curvilinear fins 40 are disposed in a spiral configuration between circular baffle 36 and annular baffle 38. By cirvilinear, it is meant that the fins, which are formed in the shape of a parallelogram, are curved as they extend radially outward. As air 60 passes through the central chamber 28 of the tubular housing 12, the fins 40 cause the air 60 to move in a circular swirling motion as it passes through the circular aperture 42 of the annular baffle 38 and out of the tubular housing 12. The curvilinear fins 40 are each formed as a parallelogram and are curved as they extend outwardly from the central axis 56 of device 10. However, the fins are spaced from the central axis 56; they are located about the periphery of the central chamber 28 in the tubular housing 12.

In a preferred embodiment, the curvilinear fins 40 are attached by means of welds or rivets to the circular baffle 36 and to the annular baffle 38. Alternatively, the circular fins 40 may be attached to the inner surface 72 of the central chamber 28, again either by welding or rivets. In a preferred embodiment, the curvilinear fins 40 are arranged in a helical configuration about the interior surface 72 of the tubular housing 12.

As shown in FIG. 4, an end cap 44 is attached to the second end 34 of the second conduit 30. The end cap 44 has an end cap circular baffle 46 contained therein and an end cap annular baffle 50 at its distal end 52. A plurality of curvilinear end cap fins 54 extend between the end cap circular baffle 46 and the end cap annular baffle 50.

In a preferred embodiment, the curvilinear end cap fins 54 are spaced from the center axis 56 of the device 10; they are located about the periphery of the second conduit 30. A circular aperture 58 is located in the end cap annular baffle 50 which allows the passage of gaseous fuel 62 out of the end cap 44. Thus, as gaseous fuel 62 passes through the second conduit 30, it impacts the end cap circular baffle 46 which retards its flow. The gaseous fuel 62 passes through the curvilinear end cap fins 54, which impart a swirling circular motion thereto. The gaseous fuel 62 impacts against the annular end cap baffle 50 which further retards its flow and causes turbulence. The gaseous fuel 62 passes through the circular aperture 58 and out of the end cap 44.

As a result of the positioning of the end cap 44, a stream of turbulent gaseous fuel 62 is emitted from the end cap 44. Similarly, a stream of turbulent air 60 is emitted from the circular opening 42 in the annular baffle 38 which surrounds the second conduit 30. The flow of turbulent air 60 is thus circumferentially disposed about the flow of turbulent gaseous fuel 62 and intermixes therewith so as to form a homogeneous mushroom shape configuration 64 of gas and air which is surrounded by turbulent air flow 60. Ignition of the mushroom shaped configuration 64 produces an instantaneous mushroom shaped flame 64, which does not come into contact with the interior surface 66 of combustion chamber 22. Further, the presence of turbulent air 60 which surrounds turbulent gaseous fueld 62 serves to completely oxidize or combust turbulent gaseous fuel 62. As a result, noxious waste gases such as carbon monoxide are substantially eliminated as a by-product of the combustion.

In order to direct turbulent air 60 about the turbulent gaseous fuel 62 as it is emitted from the end cap 44, the annular baffle 38 is sloped outwardly, i.e., in a first direction 68, from the periphery 70 of the circular opening 20 towards the end cap 44. The end cap 44 extends slightly out of the tubular housing 12. Thus, the turbulent air flow 60 is directed around the gaseous fuel 62 as it is emitted from the end cap 44.

It should be noted that although circular baffle 36 is described as circular, other shapes of baffles may be used to retard the flow of air passing through the tubular housing 12. Similarly, the relative positioning of fins 40 in the central chamber 28 may be varied, so long as turbulent swirling air is emitted from the tubular housing 12. A variety of configurations may be used to ensure that a central stream of turbulent gaseous fuel 62 is telescopically surrounded by a stream of turbulent air 60, with the turbulent air being directed so that when the gaseous fuel is ignited, a mushroom shaped flame is formed which is thoroughly oxidized.

Figure 5:
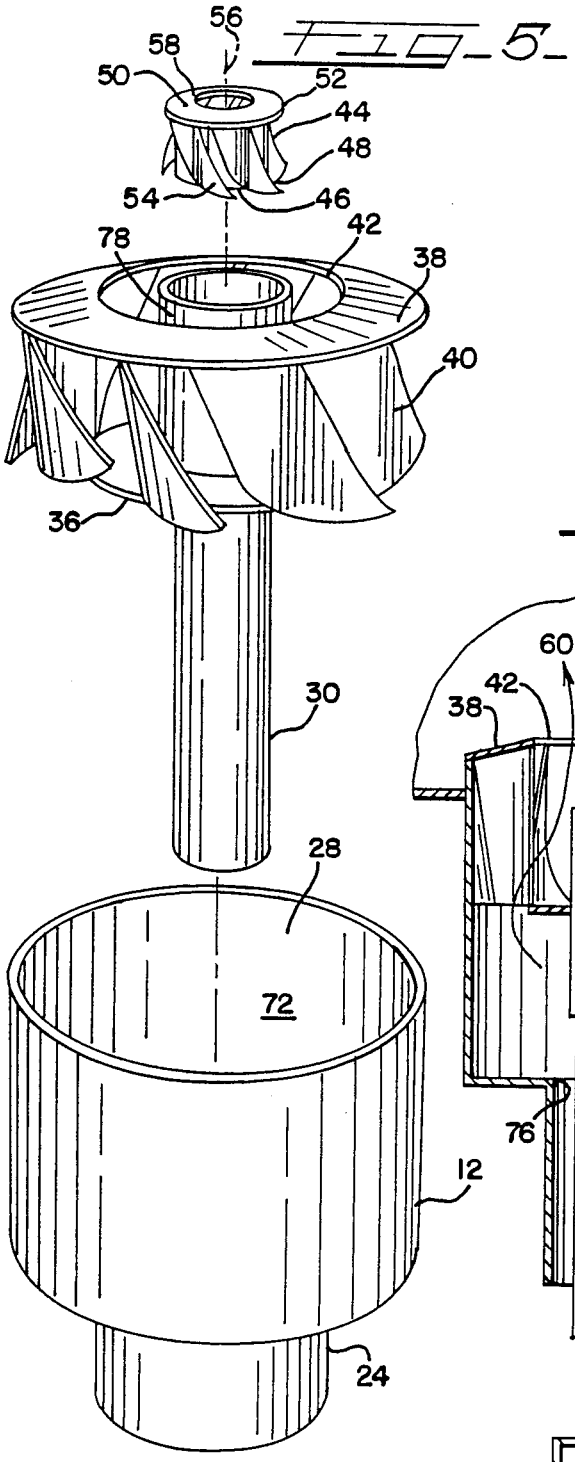
FIG. 5 is a exploded view of the improved combustion device of FIG. 1.

As shown in FIGS. 4 and 5 of the drawings, curvilinear fins 44, in a preferred embodiment, are curved in an arc of approximately 128°. In one embodiment, each of the fins 40 are separated from the other by a spacing of approximately 5½ inches at their point of attachment with the interior surface 72 of the tubular housing 12. In this embodiment, the fins 40 each measure approximately 6 inches by approximately 4 13/16 inches and are formed in the general shape of a parallelogram having an angle of approximately 29°. Further, each fin is attached to the annular baffle 38. The distance between each fin 40 at its point of attachment with the annular baffle 38 is approximately 3 inches.

The end cap member 44, in a preferred embodiment, is approximately 4 inches in diameter by approximately 6 inches long. The end cap fins 54, in a preferred embodiment, are approximately 1 9/16 inches high by approximately 2 inches long. Each of the end cap fins 54 is formed in the general shape of a parallelogram having an angle of approximately 26° and is disposed in the end cap 44 in a curvilinear configuration so as to optimize turbulence of the gaseous fuel 62 passing therethrough.

In a preferred embodiment, the tubular housing 12 has a diameter of approximately 14 inches and a length of approximately 11 inches. The first conduit 24 has a diameter of approximately 8 inches and the second conduit 30 has a diameter of approximately 3 inches. It should also be noted that at the intersection of the first conduit 24 with the tubular housing 12, the circular opening 18 has a cover 74 which substantially seals the circular opening 18, except for a circular aperture 76 which extends through the cover 74. Thus, the tubular housing 12 is substantially closed on its exterior surface at its first end 14 and is substantially open at its second end 16 through the central aperture 42 in annular baffle 38. The circular aperture 76 in the cover 74, in a preferred embodiment, has a diameter of approximately 8 inches. The circular aperture 42 in the annular baffle 38, in a preferred embodiment, has a diameter of approximately 9½ inches.

It may be seen from the dimensions set forth above that, in a preferred embodiment, the tubular housing 12 is larger in inside diameter than the first conduit 24. As a result, based on the Bernoulli Principle, (pressure drop P is proportional to the density of the fluid and the square of the velocity), gaseous fluid, in this case being air, passing into the tubular housing 12 is caused to decelerate in velocity due to the increased size of the chamber. Similarly, the end cap 44 has an inside diameter of approximately 4 inches whereas the second conduit 30 has a diameter of approximately 3 inches. As a result, again, gaseous fluid, which in this case is gaseous or vaporous fuel, is caused to decelerate when passing through the end cap 44. To accomplish this deceleration, the end cap 44 has a tubular portion 78 with a diameter of 4 inches, and a second tubular portion 80 having the same inside diameter as the second conduit 30. This deceleration of the gaseous fluid helps improve mixing of the gaseous fuel 62 with the turbulent air 60.

In a preferred embodiment, the first conduit 24, the second conduit 30, the circular baffles 36, the annular baffle 38 and the curvilinear fins 40 are constructed of stainless steel. The end cap 44 is preferably constructed of cast iron. It is particularly important that the end cap annular baffle 50 and the end cap fins 54 be constructed of cast iron or stainless steel due to their close proximity to the mushroom shaped flame so as to resist corrosion.

Figure 6:
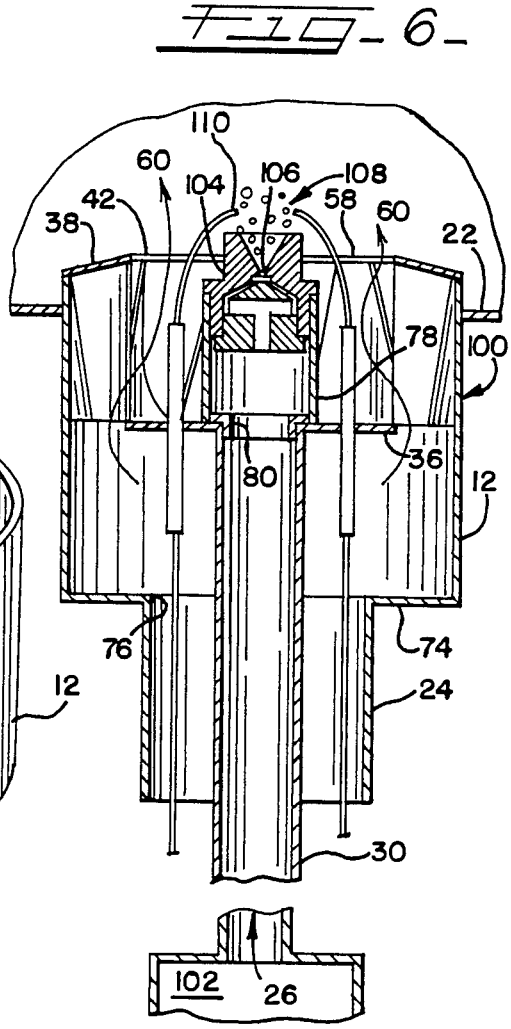
FIG. 6 is a side cut away view of an alternate embodiment of the improved combustion device of FIG. 1 having an atomizer for dispersal of liquid fuel oil in a burner of the present invention.

In an alternative embodiment of the invention best seen in FIG. 6 of the drawings, the combustion device 100 again has a first conduit 24, a second conduit 30, a tubular housing 12, a circular baffle 36, a plurality of curvilinear fins 40, and an annular baffle 38. However, the combustion device 100, in this embodiment, is designed to utilize liquid fuel oil 102 rather than gaseous fuel such as natural gas. In this case, replacing the end cap 44 is an atomizer 104 having one or more apertures 106 extending therethrough for the passage of liquid fuel oil 102, in the form of a vapor or spray of droplets 108. Again, the flow of vapor 108 are surrounded by and circumscribed by the turbulent air 60 passing from the central aperture 42 in the annular baffle 38. The mixture of fuel oil droplets 108 and air is ignited by electrodes 110. As a result, a mushroon shaped flame is again formed and the liquid fuel oil 104 is substantially oxidized, so as to substantially eliminate production of noxious by-products.

Returning to FIG. 1, in a preferred embodiment, the combustion chamber 22 contains a heat exchanger 82 which has a heat flue 84 extending therethrough. The heat from the mushroom shaped flame 64 is directed against the heat exchanger 82 thereby imparting heat to the heat flue 84 which contains air passing therethrough. In a preferred embodiment, air may be directed through heat flue 84 by means of a blower 86. Alternatively, water may be passed through the heat flue 84 for use in hot water heat. At the top 88 of the combustion chamber 22, an exhaust vent 90 may be provided. It has been found that the noxious by-products from combustion of gaseous fuel 62 are so low that no exhaust vent is required. However, it may be desirable as a safety factor.

Conventional means for supplying air and natural gas to the device 10 may be provided. For example, a gas regulator, not shown, may be connected to the second conduit 30 from an outside source of natural gas. Similarly, a blower 92 may be used for directing air into the first conduit 24. Although not shown in the drawings, in order to ignite the gaseous fuel 62 as it passes through the central aperture 58, an ignition mechanism is usually required. Either a pilot light or electronic ignition, as commonly known in the art, may be utilized.

In an alternative embodiment of the invention, a heat exchanger 82 is not present and the heat created by the mushroom shaped flame 64 is simply allowed to heat the combustion chamber 22 and radiate heat into the surrounding area. Similarly, the top 88 of combustion chamber 22 may be constructed either as a solid sheet of stainless steel, or as a grill. A novel and improved method for combustion of gaseous fuel with substantial elimination of noxious products is thereby provided.

While the present invention is designed principally for use in heating devices, the same principles may be applied to ignition of liquid and gaseous fuels in internal combustion engines, jet engines and the like.

What is claimed is:

1. A device for improved combustion comprising:

a tubular housing member having a first end and a second end, said first and second ends each having a circular opening therethrough;

a combustion chamber disposed about said second end of said—tubular—housing member;

a first conduit member extending from said first end of said tubular housing member and in fluid communication with said circular opening in said first end of said tubular housing member so as to allow the passage of air therethrough;

a second conduit member axially disposed within said first conduit member and extending through said first conduit member and through said tubular housing member to said circular opening in said second end of said tubular housing member so as to allow the passage of fuel therethrough;

means for effecting turbulence in said air passing through said tubular housing member, said means including a plurality of curvilinear fins disposed in a spiral configuration within said tubular housing member, so as to effect a swirling motion to said air passing therethrough;

means for effecting turbulence in said fuel passing through said second conduit member, said means including an end member disposed on said second conduit member proximate said second end of said tubular housing member said end member having an upper end and a lower end and a plurality of curvilinear end cap fins between said upper end and said lower end; and means for intermixing and emitting said turbulent air and said fuel in a mushroom shaped configuration with said turbulent air surrounding said mushroom shaped configuration so as to substantially eliminate noxious waste gases as a by-product of combustion of said air and fuel mixture.

2. The device of claim 1 wherein said fuel comprises fuel oil and said means for effecting turbulence in said fuel comprises an atomizer.

3. A device for improved combustion of gaseous fuel and air comprising:

a tubular housing member having a first end and a second end, said first and second ends each having a circular opening therethrough;

a combustion chamber disposed about said second end of said tubular housing member;

a first conduit member extending from said first end of said tubular housing member and in fluid communication with said tubular housing member so as to allow the passage of said air therethrough;

a second conduit member having a first end and a second end, said second conduit member being axially disposed within said first conduit member and extending through said first conduit member and through said tubular housing member so as to allow the passage of said gaseous fuel through said tubular housing member;

a circular baffle member circumferentially disposed about said second conduit member within said tubular housing member, constructed and arranged so as to retard said air passing from said first conduit member through said tubular housing member;

an annular baffle member circumferentially disposed about said second conduit member and positioned in said circular opening in said second end of said tubular housing member, said annular baffle member having a circular opening therethrough, for emission of air in a tubular stream about said second end of said second conduit;

a plurality of cirvilinear fins disposed in a spiral configuration within said tubular housing member, so as to effect a swirling motion to said air passing therethrough; and an end cap member on said second end of said second conduit member, said end cap member having an end cap circular baffle proximate its proximal end, an end cap annular baffle member proximate its distal end, and a plurality of curvilinear end cap fins extending therebetween, said end cap member being constructed and arranged to impart turbulence to said gaseous fuel passing therethrough, whereby a stream of turbulent gaseous fuel is emitted from said end cap member and said stream of turbulent air is emitted from said circular opening in said annular baffle member, said turbulent air being circumferentially disposed about said turbulent gaseous fuel and intermixing therewith so as to form a mushroom shaped flame within said combustion chamber when ignited, said mushroom shaped flame being surrounded by said turbulent air and not in contact with the interior surface of said combustion chamber, thereby substantially eliminating noxious waste gases as a by-product of said combustion.

4. The device of claim 3 wherein said annular baffle is sloped outwardly from said tubular housing member toward said end cap member and said end cap member extends from said tubular housing member so as to angularly direct said air passing from said tubular housing member toward said gaseous fuel passing from said end cap member thereby forming said mushroom shaped flame within said combustion chamber.

5. The device of claim 3 wherein each of said plurality of fins in said tubular housing member is disposed in a curvilinear configuration between said annular baffle member and said circular baffle member, said curvilinear configuration being effective to optimize the turbulence and rate of flow of said air through said tubular housing member relative to said flow of said gaseous fuel.

6. The device of claim 5 wherein said plurality of fins are curved in an arc of approximately 128° so as to optimize said circular swirling of said turbulent air.

7. The device of claim 5 wherein each of said fins is formed as a parallelogram having an angle of approximately 29°.

8. The device for improved combustion of claim 3 wherein said end cap fin members are formed in the shape of a parallelogram having an angle of approximately 26° and disposed in said end cap member in a curvilinear configuration so as to optimize turbulence of said gaseous fuel passing therethrough.

9. The device of claim 3 wherein said tubular housing member has a diameter of approximately 14 inches and a length of approximately 11 inches, said first conduit member has a diameter of approximately 8 inches and said second conduit member has a diameter of approximately 3 inches, whereby mixture of said air and said gaseous fuel entering said combustion chamber is optimized.

10. The device of claim 3 wherein said end cap member includes a tubular portion having an inside diameter larger than said second conduit so as to decrease the rate of flow of said gaseous fuel therethrough.

11. The device of claim 3 wherein said tubular housing member has an inside diameter greater in size than said first conduit member so as to decrease the rate of flow of said air passing therethrough, thereby improving mixture of said gaseous fuel with said air.

12. The device of claim 3 wherein said first conduit, said second conduit, said circular baffle, said annular baffle, and said fins are constructed of stainless steel.

13. The device of claim 3 wherein said end cap is constructed of cast iron.

14. The device of claim 3 wherein said plurality of fins are arranged in a helical configuration.

15. An improved combustion device comprising a tubular housing member having a first end and a second end, said first and second ends each having a circular opening therethrough, a combustion chamber disposed about said second end of said tubular housing member, a first conduit member extending from said first end of said tubular housing member and in fluid communication with said first end of said tubular housing member so as to allow the passage of air therethrough, a second conduit member axially disposed within said first conduit member and extending through said first conduit member and through said tubular housing member ot said circular opening in said second end of said tubular housing member so as to allow the passage of gaseous fuel therethrough, and a plurality of fins disposed in said tubular housing member, said plurality of fins being constructed and arranged so as to effect turbulence in said air passing through said fins, the improvement comprising:

an annular baffle member disposed about the periphery of said circular opening in said second end of said tubular housing member, and having said fins attached thereto, said annular baffle member being effective to retard the flow of air out of said tubular housing member, thereby imparting further turbulence to said air; and an end cap member attached to said second conduit member prximate said second end of said tubular housing member, said end cap member having a plurality of curvilinear end cap fins therein, so as to having an upper end and a lower end being impart turbulence to said gaseous fuel passing therethrough, said end cap member extending outside of said tubular housing and said annular baffle member being beveled toward said end cap member so that turbulent air is directed toward said end cap member thereby circumscribing said gaseous fuel passing from said end cap member so as cause cause said gaseous fuel to form a mushroom shaped flame upon ignition which maximizes fuel efficiency and substantially eliminates noxious waste by-products.

16. A nozzle for improved mixing of gaseous fuel and air comprising:

a tubular housing member having a first end and a second end, said first and second ends each having a circular opening therethrough;

a first conduit member extending from said first end of said tubular housing member and in fluid communication with said tubular housing member so as to allow the passage of said air therethrough;

a second conduit member having a first end and a second end, said second conduit member being axially disposed within said first conduit member and extending through said first conduit member and through said tubular housing member so as to allow the passage of said gaseous fuel therethrough;

a circular baffle member circumferentially disposed about second conduit member within said tubular housing member, constructed and arranged so as to retard said air passing through said tubular housing;

an annular baffle member disposed in said circular opening in said second end of said tubular housing member, said annular baffle member being effective to retard the flow of said air out of said tubular housing member;

a plurality of curvilinear fins disposed in a spiral configuration between said circular baffle member and said annular baffle member, said plurality of fins being disposed so as to effect a swirling motion to said air passing through said tubular housing; and an end cap member attached to said second end of said second conduit member, said end cap member having an end cap circular baffle member at its proximal end, an end cap annular baffle member at its distal end, and a plurality of end cap fins extending therebetween, said end cap member being constructed and arranged to impart turbulence to said gaseous fuel passing therethrough;

whereby said stream of turbulent gaseous fuel is emitted from said end cap member and said stream of turbulent air is emitted from said circular opening in said second end of said tubular housing member, said turbulent air being circumferentially disposed about said tubulent gaseous fuel and intermixing therewith so as to form a mushroom shaped flame when ignited, said mushroom shaped flame being surrounded by said turbulent air, thereby substantially eliminating noxious waste gases as a by-product of said combustion.

17. A nozzle for improved mixing of gaseous fuel and air comprising;

a tubular housing member having a first end and a second end, said first and second ends each having a circular opening therethrough;

a first conduit member extending from said first end of said tubular housing member and in fluid communication with said circular opening in said first end of said tubular housing member so as to allow the passage of air therethrough;

a second conduit member axially disposed within said first conduit member and extending through said first conduit member and through said tubular housing member to said circular opening in said second end of said tubular housing member so as to allow the passage of fuel therethrough;

means for effecting turbulence in said air passing through said tubular housing member, said means including a plurality of curvilinear fins disposed in a spiral configuration within said tubular housing member, so as to effect a swirling motion to said air passing therethrough;

means for effecting turbulence in said fuel passing through said second conduit member—including an end member disposed on said second conduit member proximate said second end of said tubular housing member said end member having an upper end and a lower end, said end member having a plurality of curvilinear end cap fins between said upper end and said lower end; and means for intermixing and emitting said turbulent air and said fuel in a mushroom shaped configuration with said turbulent air surrounding said mushroom shaped configuration so as to substantially eliminate noxious waste gases as a by-product of combustion of said air and fuel mixture.

* * * * *